US006782646B1

(12) United States Patent
Devaney

(10) Patent No.: US 6,782,646 B1
(45) Date of Patent: Aug. 31, 2004

(54) SYSTEM AND METHOD FOR MOUNTING SHEET MATERIAL ON SUPPORT STRUCTURES

(75) Inventor: Brandon D. Devaney, Huntsville, AL (US)

(73) Assignee: Tara Advertising Systems, L.L.C., Owens Cross Roads, AL (US)

( * ) Notice: Subject to any disclaimer, the term of this patent is extended or adjusted under 35 U.S.C. 154(b) by 48 days.

(21) Appl. No.: 10/082,428

(22) Filed: Feb. 25, 2002

(51) Int. Cl.[7] ..... G09F 21/04
(52) U.S. Cl. ..... 40/590; 40/603
(58) Field of Search ..... 40/603, 590

(56) References Cited

U.S. PATENT DOCUMENTS

| | | | | | |
|---|---|---|---|---|---|
| 4,922,988 | A | | 5/1990 | Loomis | |
| 5,140,765 | A | * | 8/1992 | King | 40/603 |
| 5,239,765 | A | | 8/1993 | Opdahl | 40/603 |
| 5,349,772 | A | | 9/1994 | Pardue | 40/590 |
| 5,467,546 | A | | 11/1995 | Kovalak, Jr. | 40/603 |
| 5,507,109 | A | | 4/1996 | Rinzler | 40/603 |
| 5,647,155 | A | * | 7/1997 | Hillstrom | 40/603 |
| 5,657,566 | A | | 8/1997 | Key | 40/590 |
| 5,664,354 | A | | 9/1997 | Daviau et al. | 40/603 |
| 5,669,166 | A | | 9/1997 | Verret | 40/603 |
| 5,685,099 | A | | 11/1997 | Favata | 40/590 |
| 5,893,227 | A | | 4/1999 | Johansson et al. | 40/603 |
| 5,992,070 | A | * | 11/1999 | Birnbaum | 40/603 |
| 6,041,535 | A | | 3/2000 | Holloway et al. | 40/603 |
| 6,167,649 | B1 | | 1/2001 | Palmeri | 40/603 |
| 6,209,245 | B1 | | 4/2001 | Wittenberg | 40/603 |
| 6,250,002 | B1 | | 6/2001 | Wittenberg | 40/603 |
| 6,276,082 | B1 | | 8/2001 | Richards et al. | 40/603 |
| 6,305,111 | B1 | | 10/2001 | Opdahl | 40/603 |

* cited by examiner

*Primary Examiner*—Joanne Silbermann
(74) *Attorney, Agent, or Firm*—Waddey & Patterson, P.C.; Larry W. Brantley

(57) ABSTRACT

The system and method of the present invention includes an upper frame mounted on a support structure, such as a truck, building, or billboard, three adjustable frame assemblies mounted on the support structure below the upper frame, and sheet material having an upper sheet tab inserted into the upper frame and lower, right, and left sheet tabs inserted into the adjustable frame assemblies. The frame assemblies can be adjusted to vary the tension in the sheet material between the upper frame and the adjustable frame assemblies. The method includes the steps of inserting the upper sheet tab into the upper frame, inserting the right, left, and lower sheet tabs into the adjustable frame assemblies, and adjusting the adjustable frame assemblies so that the sheet material is pulled taut between the upper frame and the adjustable frame assemblies.

16 Claims, 8 Drawing Sheets

SYSTEM AND METHOD FOR MOUNTING SHEET MATERIAL ON SUPPORT STRUCTURES

BACKGROUND OF THE INVENTION

The present invention relates generally to systems and methods for advertising products and services on a support structure. More particularly, this invention pertains to a system and method for mounting sheet material containing advertisements on support structures, such as trucks, buildings, and billboards.

Systems and methods for mounting sheet material containing advertisements on support structures, such as trucks, buildings, and billboards, are known in the art. For example, U.S. Pat. No. 6,276,082, issued to Richards et al. on Aug. 21, 2001 and entitled "Mounting for Sheet Material," U.S. Pat. No. 6,250,002, issued to Wittenberg on Jun. 26, 2001 and entitled "Visually Symmetric Removable Low Protrusion Tensioned Sign Display System," and U.S. Pat. No. 6,041,535, issued to Holloway et al. on Mar. 28, 2000 and entitled "Flexible Sign Retention and Tensioning Frame Assembly," teach various types of systems and methods for mounting sheet material containing advertisements on support structures. All of these patents, however, teach the use of sheet material having a beaded portion defined along the top, bottom, and sides of the sheet material, and frame members that include a partially open cylindrical element for receiving the beaded portions of the sheet material.

To mount the sheet material to the frame members, the beaded portions must be slide into the partially open cylindrical elements of the frame members. This process is time-consuming and costly, and makes the use of the systems and methods described in these patents less desirable for users who need to install or remove sheet material very quickly. Accordingly, there is a need for a quicker way to connect the sheet material to the support structure.

Furthermore, the systems and methods described in the '082 and the '535 patents also require the use of special tools to adjust the tension in the sheet material once it is mounted on the support structure. These special tools increase the cost of these systems and make it difficult, if not impossible, to adjust the tension in the sheet material when the tools are not available. This requirement, not surprisingly, makes these systems even more undesirable to some users. Thus, there is a need for a way of adjusting tension in the sheet material without using a special tool.

U.S. Pat. No. 6,305,111, issued to Opdahl on Oct. 23, 2001 and entitled "Advertising Display System," U.S. Pat. No. 6,167,649, issued to Palmeri on Jan. 2, 2001 and entitled "Information Display System for the Sides of Buildings and Vehicles," U.S. Pat. No. 5,685,099, issued to Favata on Nov. 11, 1997 and entitled "Trailer Sign Frame," U.S. Pat. No. 5,349,772, issued to Pardue on Sep. 27, 1994 and entitled "Flexible Frame Mobile Display," U.S. Pat. No. 5,239,765, issued to Opdahl on Aug. 31, 1993 and entitled "Advertising Display," and U.S. Pat. No. 4,922,988, issued to Loomis on May 8, 1990 and entitled "Tension Mounting System and Assembly," also teach systems and methods for mounting sheet material containing advertisements to support structures, such as trucks, buildings, and billboards. The systems and methods described in these patents require the use of sheet material having a sleeve defined along the border of the sheet material and a support, which is either slide into or stitched into the sleeve.

As was the case with the '082, '002, and '535 patents above, the process of sliding the support into the sleeve is time-consuming and costly, and makes the use of the systems and methods described in these patents less desirable for users who need to install or remove sheet material very quickly. In addition, the use of sleeves increases the amount of, and the associated cost of, material used for a given piece of sheet material—a fact that also makes these systems undesirable. As a result, there is need for not only a quicker way to connect the sheet material to the support structure in these systems, but also a way to reduce the amount of material used for a given piece of sheet material.

Finally, while other systems and methods for mounting sheet material containing advertisements on support structures are known in the art, such as those described in U.S. Pat. No. 6,209,245, issued to Wittenberg on Apr. 3, 2001 and entitled "Sign Display Attachment System," U.S. Pat. No. 5,893,227, issued to Johansson et al. on Apr. 13, 1999 and entitled "Fabric Sign With Tensioning Means," U.S. Pat. No. 5,669,166, issued to Verret on Sep. 23, 1997 and entitled "Casing for Sign," U.S. Pat. No. 5,664,354, issued to Daviau, et al. on Sep. 9, 1997 and entitled "Wall and Vehicle Graphic Assemblies," U.S. Pat. No. 5,657,566, issued to Key on Aug. 19, 1997 and entitled "Rapid Mount Advertising Panels," U.S. Pat. No. 5,507,109, issued to Rinzler on Apr. 16, 1996 and entitled "Mobile Advertising Display," and U.S. Pat. No. 5,467,546, issued to Kovalak, Jr. on Nov. 21, 1995 and entitled "Tensioned Fabric Sign," all of these known systems and methods are substantially different from the systems and methods described above and, accordingly, do not address or solve the disadvantages of the prior art discussed above.

What is needed, then, is a system and method for mounting sheet material containing advertisements on support structures, such as trucks, buildings, and billboards, that includes a method of connecting the sheet material to the support structure more quickly, that does not require a special tool to adjust the tension in the sheet material, and that reduces the amount of material needed for a given piece of sheet material.

SUMMARY OF THE INVENTION

Accordingly, one object of the present invention is to provide a system and method of connecting the sheet material to support structures more quickly than existing prior art sliding systems, Another object is to provide a system and method that does not require a special tool in order to adjust the tension in the sheet material.

Still another object of the present invention is to provide a system and method that reduces the amount of material needed for a given piece of sheet material.

These and other objects, which will become apparent to someone practicing the present invention, are satisfied by the system and method of the present invention. The system includes an upper frame mounted on an upper portion of a support structure, such as a truck, building, or billboard, three adjustable frame assemblies mounted on left, right and lower portions of the support structure below the upper frame, and sheet material having upper, right, left, and lower sheet tabs that are inserted into the upper frame and the adjustable frame assemblies. The adjustable frame assemblies can be adjusted to vary the tension in the sheet material between the upper frame and the adjustable frame assemblies. The method includes the steps of inserting the sheet tabs into the upper frame and the adjustable frame assemblies, and adjusting the adjustable frame assemblies so that the sheet material is pulled taut between the upper frame and the adjustable frame assemblies.

DESCRIPTION OF THE PREFERRED EMBODIMENTS

Figure 2:
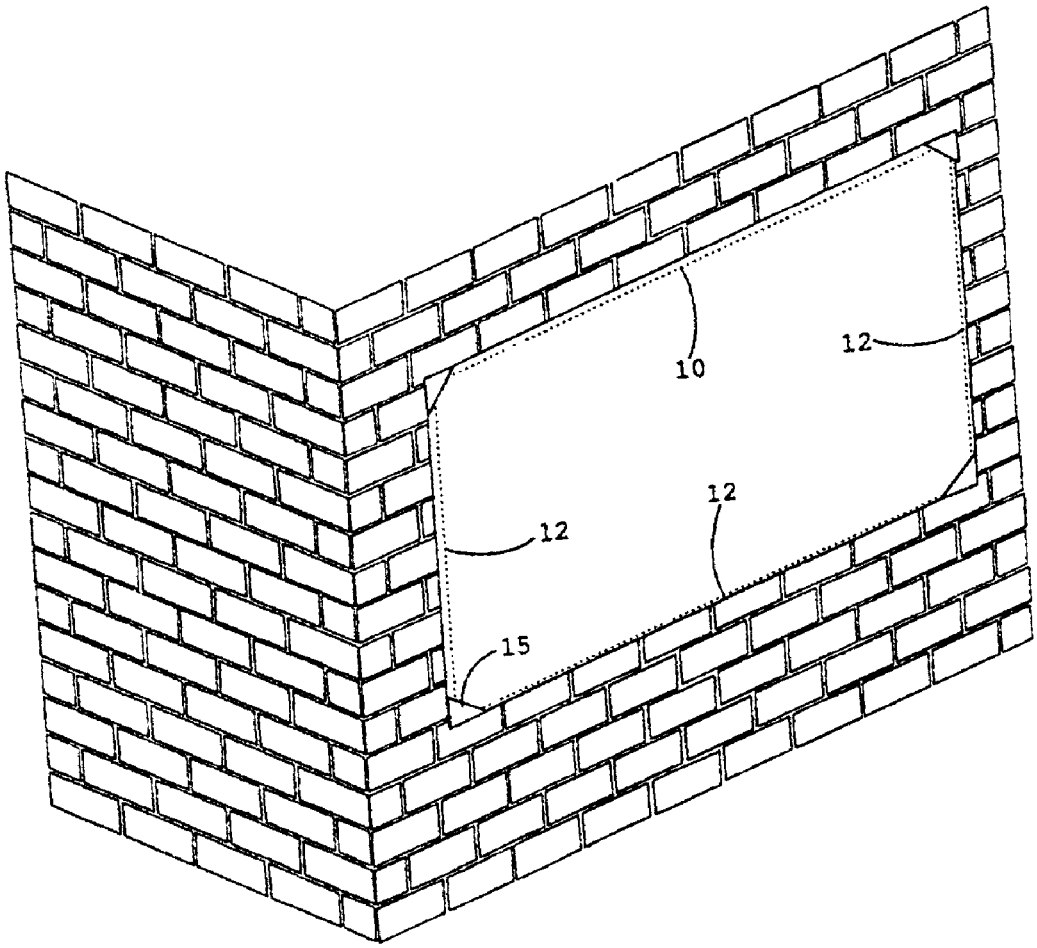
FIG. 2 is a perspective view of the embodiment of the present invention shown in FIG. 1 mounted on a building.
Figure 3:
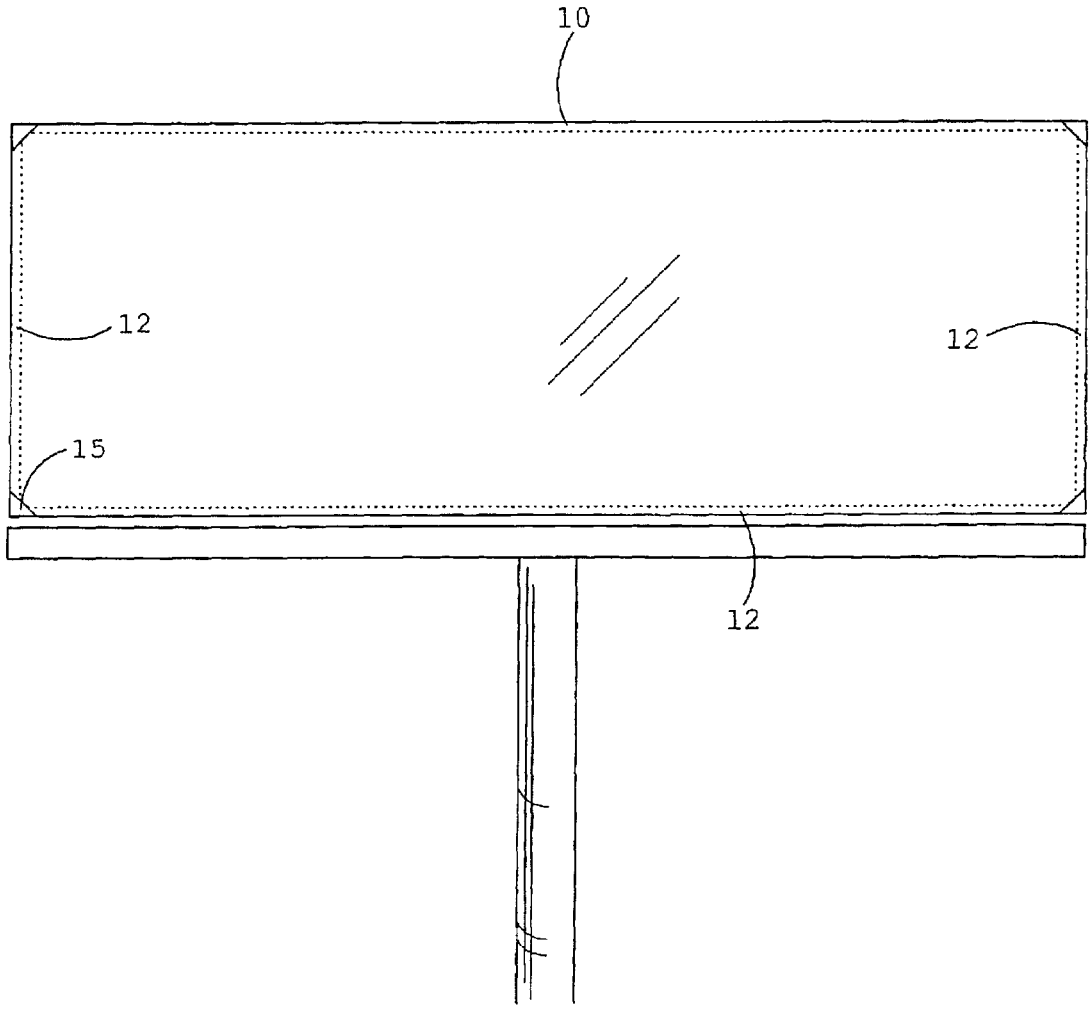
FIG. 3 is a side view of the embodiment of the present invention shown in FIG. 1 mounted on a billboard.

As an initial note, the present invention can be used to mount sheet material containing advertisements on a wide variety of support structures. For example, the present invention can be used to mount sheet material containing advertisements on a truck (FIG. 1), a building (FIG. 2), and a billboard (FIG. 3). For purposes of clarity, however, the following description will illustrate the use of the present invention with a truck. The present invention can be used with buildings and billboards in a manner similar to that described below for the truck.

Figure 1:
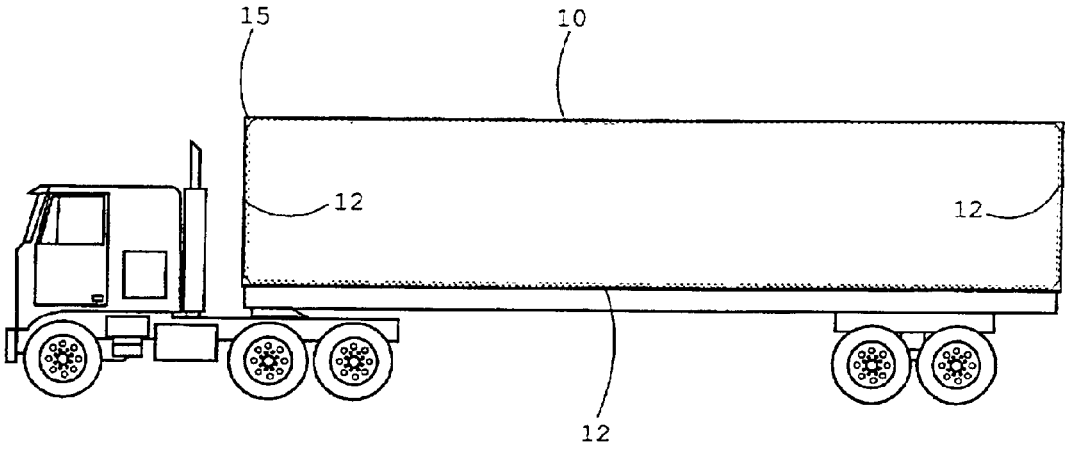
FIG. 1 is a side view of one embodiment of the present invention mounted on a truck.
Figure 4:
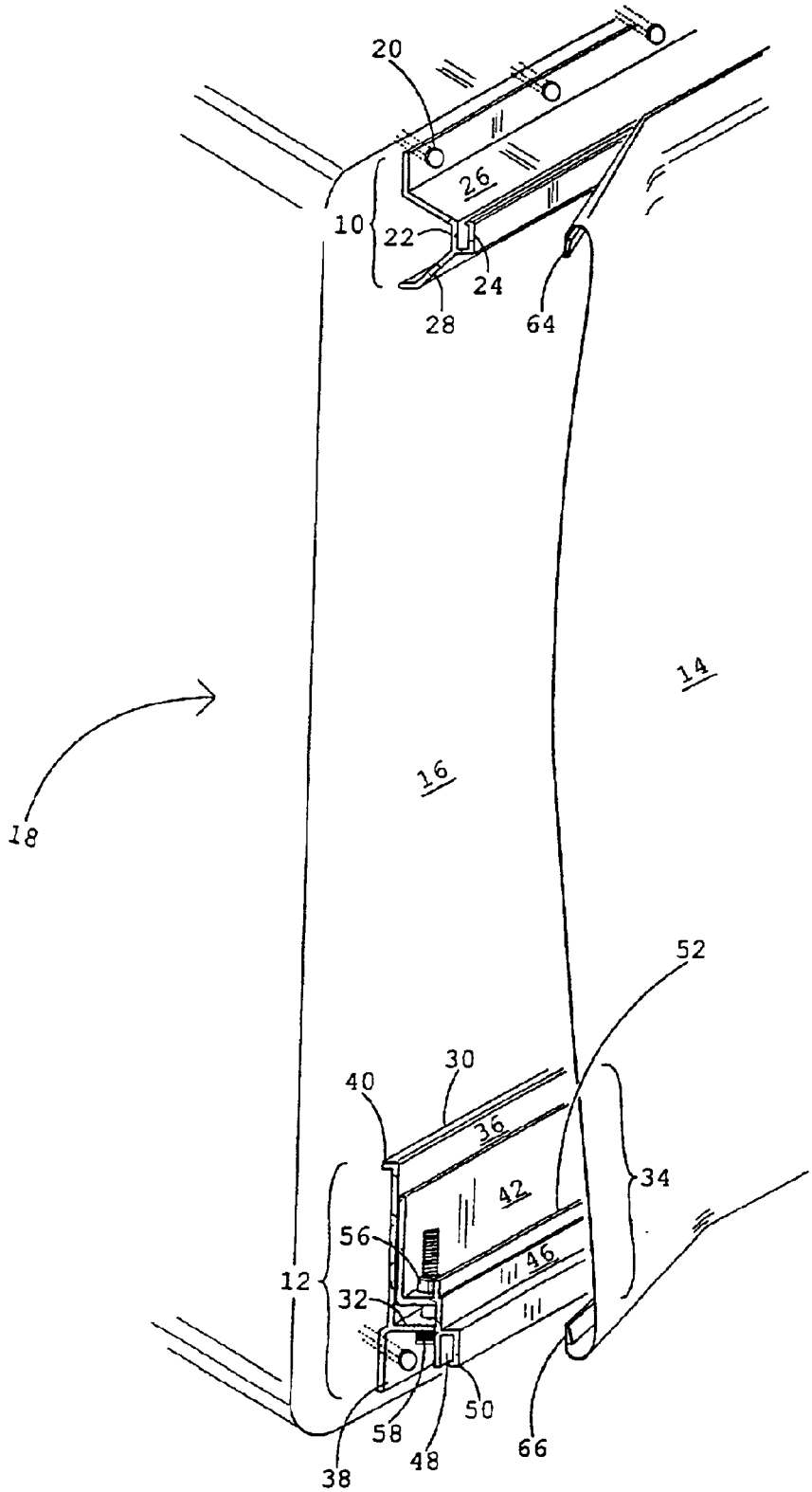
FIG. 4 is a perspective view of the embodiment of the present invention shown in FIG. 1.

Referring to FIGS. 1 and 4, the present invention includes an upper frame 10, adjustable frame assemblies 12, sheet material 14, and corner caps 15. The upper frame 10 and the adjustable frame assemblies 12 are mounted on the support structure 16, which in FIG. 4 is the side 16 of a truck 18, using conventional mounting techniques, e.g., using screws 20. The corner caps 15, which are optional, are mounted on the frames and cover gaps between the upper frame 10 and the adjustable frame assemblies 12.

Figure 5:
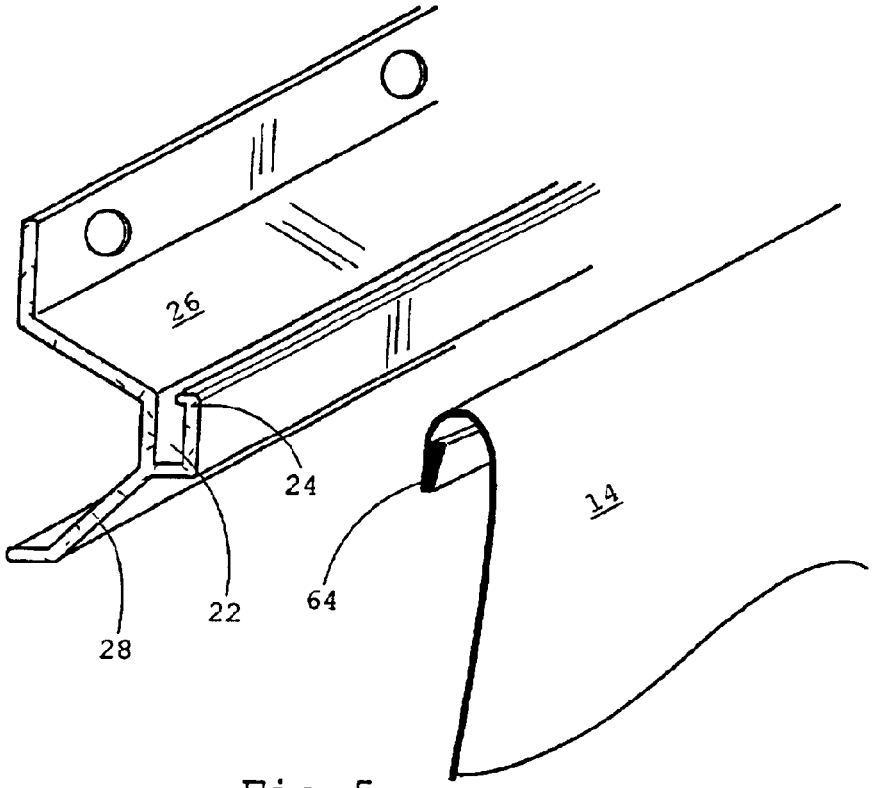
FIG. 5 is an enlarged perspective view of the upper frame and upper sheet tab shown in FIG. 4.
Figure 6:
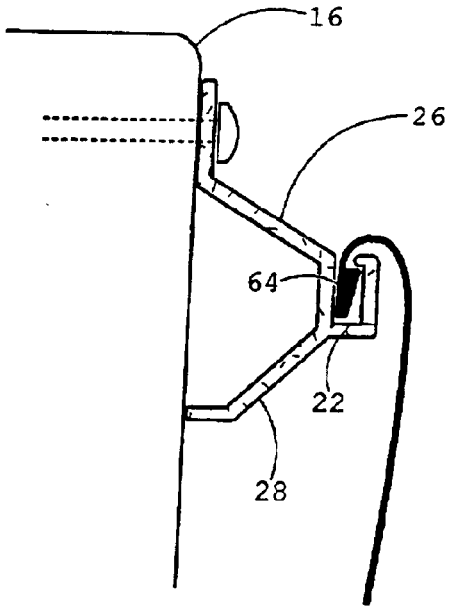
FIG. 6 is an enlarged side view of the upper frame shown in FIG. 4 with the upper sheet tab inserted into the upper frame.
Figure 7:
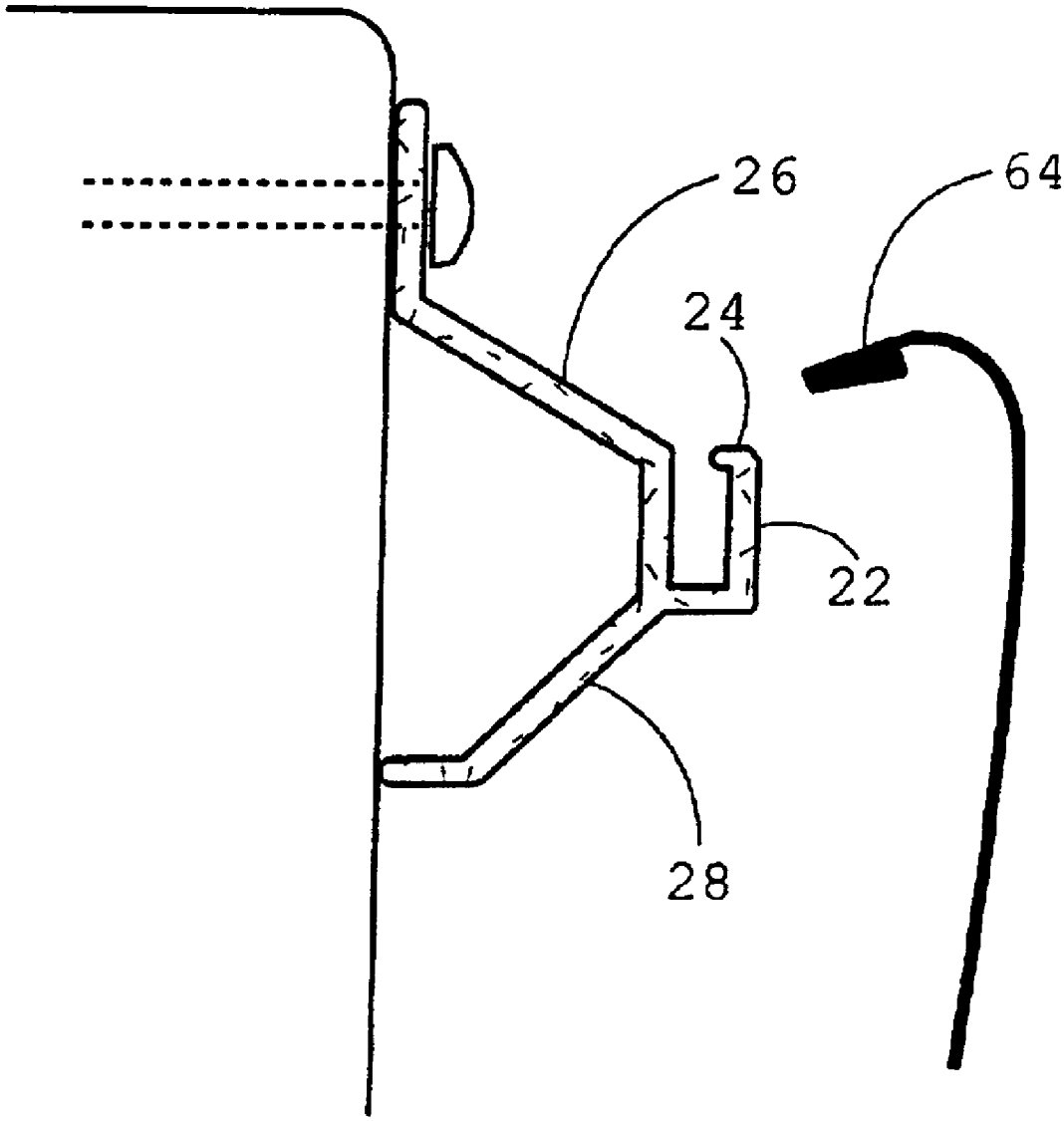
FIG. 7 is an enlarged side view of the upper frame shown in FIG. 4 showing the upper sheet tab positioned for insertion into the upper frame.

Referring to FIGS. 5–7, the upper frame 10 includes a rectangular-shaped, upper channel 22 having an upper flange 24 defined therein, a first leg 26 extending in an upward direction away from the upper channel 22 and connected to the support structure 16, and a second leg 28 extending in a downward direction away from the upper channel 22 and resting against the support structure 16. In one embodiment, the upper frame 10 is manufactured out of aluminum or some other type of strong, lightweight material. In alternative embodiments, other materials, such as plastic, may be used as well.

All three of the adjustable frame assemblies 12 mounted to the support structure are identical. Accordingly, only the adjustable frame assembly 12 mounted on the support structure 16 directly below the upper frame 10 is discussed in detail below. The other two adjustable frame assemblies mounted on the left and right portions of the support structure 16 as shown in FIG. 1, however, are identical to the adjustably frame assembly 12 mounted below the upper frame 10.

Figure 8:
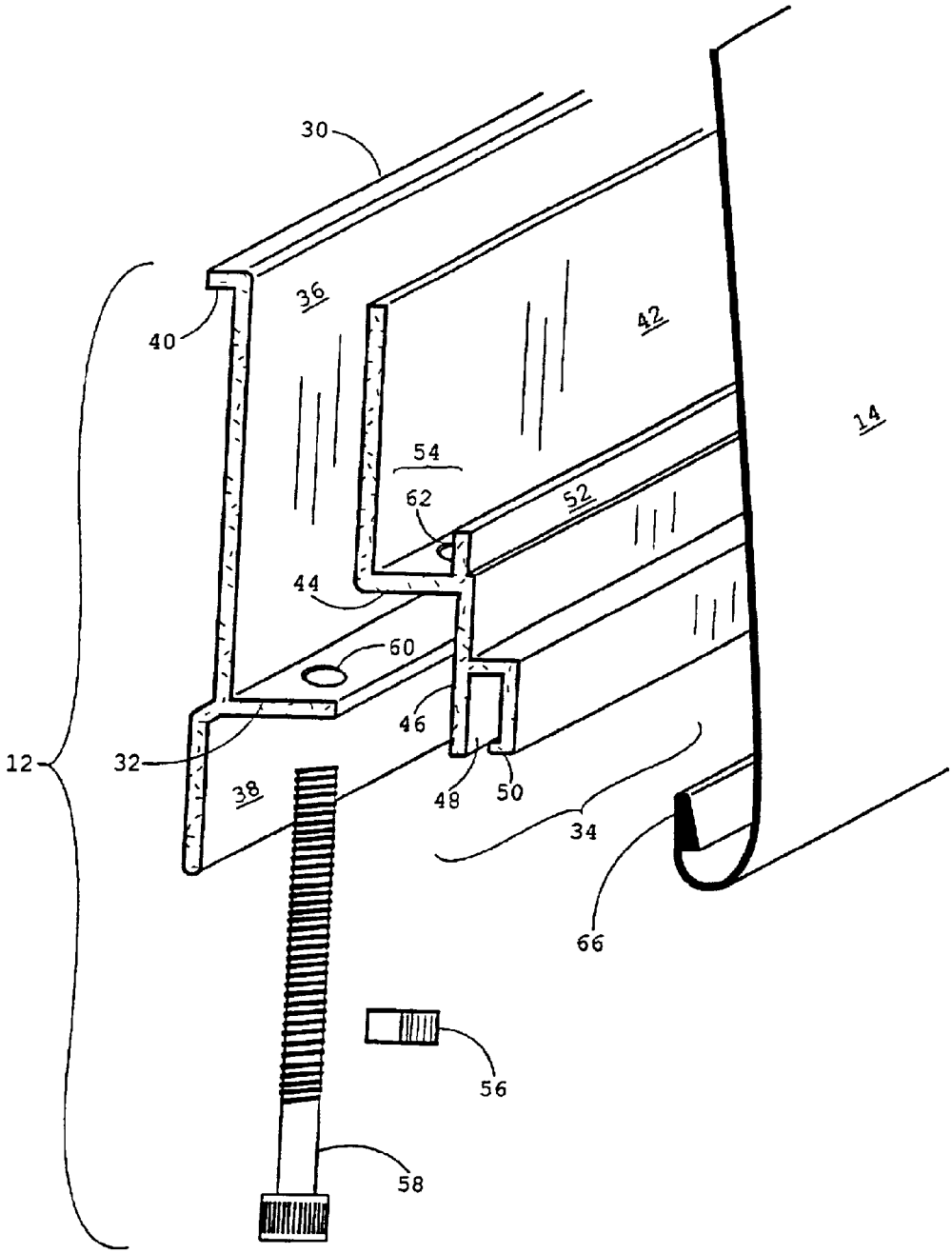
FIG. 8 is a an enlarged exploded view of the adjustable lower frame assembly and lower sheet tab shown in FIG. 4.

Referring to FIGS. 4 and 8, the adjustable frame assembly 12 mounted directly below the upper frame 10 (also referred to as "the adjustable lower frame assembly 12") includes a lower frame 30 having a stop segment 32 defined therein mounted on the support structure 16 and a tension frame member 34 adjustably connected to the lower frame 30 so that the tension frame member 34 can move relative to the stop segment 32. The lower frame 30 includes an upper frame segment 36 connected to and approximately perpendicular to the stop segment 32 and extending upward away from the stop segment 32, and a lower frame segment 38 connected to and approximately perpendicular to the stop segment 32 and extending downward away from the stop segment 32. The upper frame segment 36 includes a frame tab 40 extending outward away from and approximately perpendicular to the upper frame segment 36 and the upper and lower frame segments, 36 and 38, are offset from and approximately parallel to each other.

The tension frame member 34 includes an upper tension segment 42, an intermediate segment 44 connected to and approximately perpendicular to the upper tension segment 42, and a lower tension segment 46 connected to and approximately perpendicular to the intermediate segment 44. The upper tension segment 42 extends upward away from the intermediate segment 44 and the lower tension segment 46 extends downward away from the intermediate segment 44. The lower tension segment 46 includes a rectangular-shaped lower channel 48 having a lower flange 50 defined therein and a nut segment 52 connected to and approximately perpendicular to the intermediate segment 44. The nut segment 52, which extends upward away from the intermediate segment 44, in conjunction with the upper tension segment 42, forms a nut channel 54.

Figure 9:
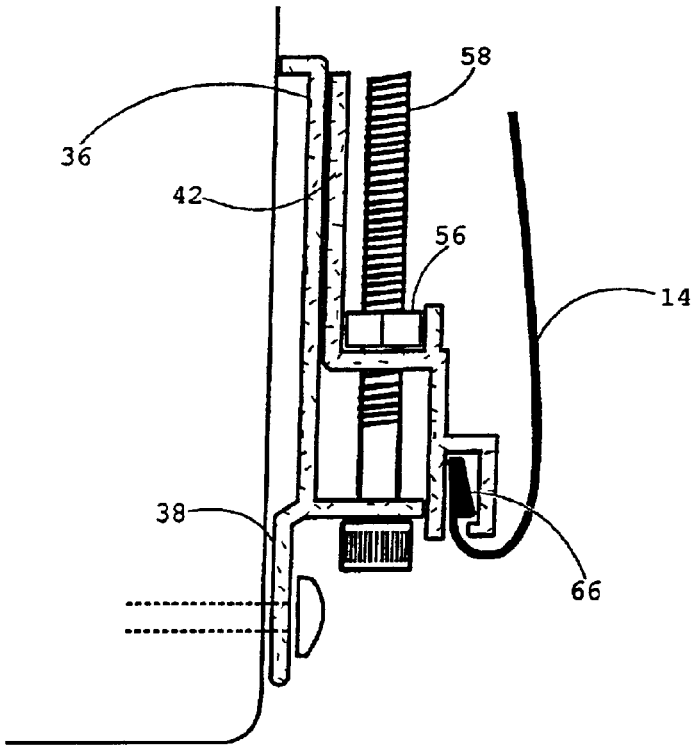
FIG. 9 is an enlarged side view of the adjustable lower frame assembly shown in FIG. 4 with the adjustable frame assembly adjusted so that the sheet material is relaxed.
Figure 10:
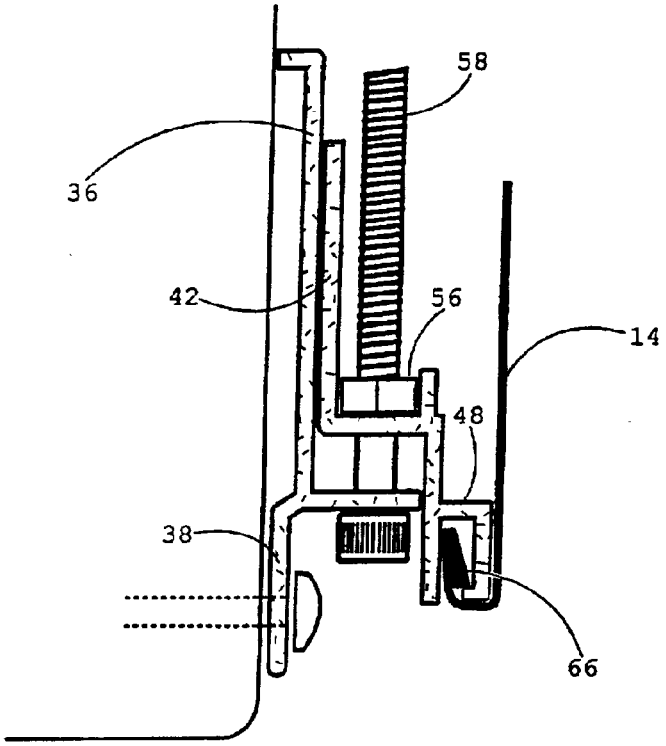
FIG. 10 is an enlarged side view of the adjustable lower frame assembly shown in FIG. 4 with the adjustable frame assembly adjusted so that the sheet material is pulled taut.

The adjustable lower frame assembly 12 also includes a nut 56 and a bolt 58 that are used to adjustably connect the tension frame member 34 to the lower frame 30. Referring to FIG. 8, the bolt 58 passes through a lower bolt opening 60 defined in the stop segment 32, an upper bolt opening 62 defined in the intermediate segment 44, and into engagement with the nut 56, which is received in the nut channel 54 adjacent to the upper bolt opening 62. Referring to FIGS. 9 and 10, the tension frame member 34 is adjusted relative to the lower frame 30 by turning the bolt 58 with a conventional tool, such as a wrench (not shown). When the bolt 58 is turned one direction, the tension frame member 34 moves upward away from the stop segment 32 (see FIG. 9) and, when the bolt 58 is turned in the opposite direction, the tension frame member 34 moves downward toward the stop segment 32 (see FIG. 10).

Although FIGS. 8–10 only show one nut 56 and bolt 58, the present invention includes a number of nuts 56 and bolts 58 spaced along the length of the tension frame member 34. The actual number of nuts and bolts required to adjustably connect the tension frame member 34 to the lower frame 30 varies depending on the length of the tension frame member 34 and lower frame 30. For example, in one embodiment, where the tension frame member 34 and lower frame 30 are approximately three (3) feet long, the present invention includes two nuts 56 and bolts 58 positioned approximately six (6) inches from the ends of the tension frame member 34 and lower frame 30 and one nut 56 and bolt 58 positioned at the midpoint between the other two nuts 56 and bolts 58. As a result, the nuts 56 and bolts 58 are spaced approximately eighteen (18) inches apart.

Furthermore, although only portions of the upper frame 10 and the adjustable lower frame assembly 12 are shown in the figures, the upper frame 10 and the adjustable lower frame assembly 12 may include multiple segments. For example, in one embodiment where the present invention is mounted on a forty-eight foot truck, the upper frame 10 includes four 12 foot upper frame segments (not shown), the adjustable lower frame assembly 12 includes four 12 foot lower frame segments 30 and four 12 foot tension frame member segments 34, and the adjustable left and right frame assemblies (not shown) are approximately 6–8 feet long. In alternative embodiments, the actual number of segments can be varied to meet the requirements of a particular application.

Referring back to FIG. 4, sheet material 14 includes a printed advertisement (not shown) on the surface thereof, wedge-shaped upper and lower sheet tabs, 64 and 66, and wedge-shaped left and right sheet tabs (not shown). The wedge-shaped left and right sheet tabs are identical to the upper and lower sheet tabs, 64 and 66. For purposes of clarity, however, the wedge-shaped left and right sheet tabs are not shown in FIG. 4. The sheet material 14 may be any one of the many types of conventional sheet materials known in the art. For example, in one embodiment, the sheet material 14 is manufactured out of flexible plastic or vinyl.

The sheet material 14 is mounted on the support structure 16 in the following manner. Upper frame 10 and adjustable frame assemblies 12 are mounted on the support structure 16 using conventional mounting techniques. The upper sheet tab 64 is inserted into the upper channel 22 so that the upper tab 64 presses against and is held in the upper channel 22 by the upper flange 24. The lower sheet tab 66 is inserted into the lower channel 48 so that the lower tab 66 presses against and is held in the lower channel 48 by lower flange 50. The left and right sheet tabs (not shown) are inserted into the adjustable frame assemblies (not shown) positioned on the left and right sides of the support structure 16 in a similar manner.

To facilitate the insertion of the upper and lower sheet tabs, 64 and 66, the lower frame 30 and the tension frame member 34 are adjusted by turning the bolt 58 so that the sheet material 14 has a small amount of slack when the upper and lower sheet tabs, 64 and 66, are inserted into the upper frame 10 and the tension frame member 34. Finally, while the upper and lower sheet tabs, 64 and 66, are held in the upper and lower channels, 22 and 48, the sheet material 14 is pulled taut by turning the bolt 58 and moving the tension frame member 34 downward away from the upper frame 10. The left and right sheet tabs (not shown) are inserted into the adjustable frame assemblies (not shown) mounted on the left and right sides of the support structure 16 in a similar manner.

In one alternative embodiment, the present invention includes a left frame, which is identical to the upper frame with the exception that it is mounted to the left of the upper frame, and an adjustable right frame assembly, which is identical to the adjustable lower frame assembly with the exception that it is mounted to the right of the upper frame. In another embodiment, the upper frame is replaced with an adjustable frame assembly that is identical to the adjustable lower frame assembly so that the present invention includes four adjustable frame assemblies. In a third alternative embodiment, the upper frame and the adjustable frame assemblies are adapted to be connected to each other by screws or by welding to form a frame that can be free standing, i.e., not connected to a support structure, or, in the alternative, mounted on a support structure.

Thus, although there have been described particular embodiments of the present invention of a new and useful "System And Method For Mounting Sheet Material On Support Structures, Such As Trucks, Buildings, and Billboards," it is not intended that such references be construed as limitations upon the scope of this invention except as set forth in the following claims.

The invention claimed is:

1. A sheet material mounting assembly, comprising:

a lower frame, the lower frame including a stop segment, an upper frame segment connected to and approximately perpendicular to the stop segment and extending upward away from the stop segment, and a lower frame segment connected to and approximately perpendicular to the stop segment and extending downward away from the stop segment; and a tension frame member adjustably connected to the lower frame so that the tension frame member can move relative to the stop, the tension frame member comprising:

an upper tension segment;

an intermediate segment connected to and approximately perpendicular to the upper tension segment;

a lower tension segment connected to and approximately perpendicular to the intermediate segment, the lower tension segment including a lower channel having a lower flange defined therein;

the upper tension segment extending upward away from the intermediate segment and the lower tension segment extending downward away from the intermediate segment;

a nut segment connected to and approximately perpendicular to the intermediate segment, the nut segment extending upward away from the intermediate segment; and wherein the upper tension segment and the nut segment form a nut channel.

2. The mounting assembly of claim 1, wherein the lower channel is approximately rectangular-shaped.

3. The mounting assembly of claim 2, wherein:

the upper frame segment includes a frame tab extending outward away from and approximately perpendicular to the upper frame segment; and the upper and lower frame segments are offset from and approximately parallel to each other.

4. The mounting assembly of claim 3, wherein the lower frame is adapted to be connected to a support structure.

5. The mounting assembly of claim 1, further comprising:

an upper frame;

sheet material, having an upper sheet tab inserted into the upper frame and a lower sheet tab attached to the lower channel in the tension frame member, extending between the upper frame and the tension frame member; and wherein the tension frame member can be adjusted with respect to the lower frame to vary the tension in the sheet material.

6. The mounting assembly of claim 5, wherein:

the upper frame includes an upper channel having an upper flange defined therein.

7. The mounting assembly of claim 6, wherein the upper and lower sheet tabs are wedge-shapes.

8. The mounting assembly of claim 7, wherein the upper channels is approximately rectangular-shaped.

9. The mounting assembly of claim 8, wherein the upper frame and the lower frame are mounted on a support structure.

10. The mounting assembly of claim 9, wherein the support structure includes a truck, building, or billboard.

11. A method of mounting sheet material comprising the steps of:

mounting an upper frame on a support structure;

mounting an adjustable lower frame assembly on the support structure below the upper frame, the step of mounting the adjustable lower frame assembly including the steps of mounting a lower frame on the support structure and adjustably connecting a tension frame member to the lower frame so that the tension frame member can move relative to a stop defined in the lower frame, the step of adjustably connecting the tension frame member to the lower frame including the steps of inserting a nut in a nut channel defined in the tension frame member and passing a bolt through the stop defined in the lower frame and the tension frame member into engagement with the nut;

inserting a wedge-shaped upper sheet tab connected to the sheet material into an upper channel defined in the upper frame;

pulling the upper sheet tab against an upper flange defined in the upper channel;

inserting a wedge-shaped lower sheet tab connected to the sheet material into a lower channel defined in the adjustable lower frame assembly;

pulling the lower sheet tab against a lower flange defined in the lower channel;

adjusting the adjustable lower frame assembly so that the sheet material is pulled taut between the upper frame and the adjustable lower frame assembly.

12. The method of claim 11, wherein the steps of mounting the upper frame and the lower frame assembly on the support structure include the steps of mounting the upper frame and lower frame assembly on a truck, building, or billboard.

13. A flexible sheet mounted on an adjustable frame assembly, comprising:

a first non-adjustable frame comprising:

a first channel having a first flange defined therein; and a first leg connected to the first channel, the first leg adapted to be fixedly connected to a support structure;

a first adjustable frame comprising:

a fixed fame member comprising a fixed frame segment adapted to be fixedly connected to a support structure; and a stop segment connected to and extending from the fixed frame segment;

a tension frame member comprising:

a tension segment, the tension segment including a second channel having a second flange defined therein; and an intermediate segment connected to and extending from the tension segment; and a tensioning member adjustably connected to the stop segment and connected to the intermediate segment; and a flexible sheet extending between the first non-adjustable frame and the first adjustable frame, the sheet having an first sheet tab inserted into the first channel and a second sheet tab inserted into the second channel; and wherein, the tensioning member is adapted to adjustably position the intermediate segment a selected distance from the stop segment so as to provide and adjust tension in the sheet between the first adjustable frame and the first non-adjustable frame.

14. The apparatus of claim 13, wherein the first channel is approximately rectangular-shaped and wherein the second channel is approximately rectangular-shaped.

15. The assembly of claim 13, wherein the first and second sheet tabs are wedge-shaped.

16. The assembly of claim 13, further comprising:

a second non-adjustable frame disposed adjacent to and extending perpendicular from the first non-adjustable frame; and a second adjustable frame disposed adjacent to and extending perpendicularly from the first adjustable frame, wherein the flexible sheet extends between the second non-adjustable frame and the second adjustable frame, the sheet having an third sheet tab inserted into the second non-adjustable frame and a fourth sheet tab inserted into the second adjustable frame; and wherein, the second adjustable frame is adapted to provide and adjust tension in the sheet between the second adjustable frame and the second non-adjustable frame.

* * * * *